United States Patent [19]

Vukmanic et al.

[11] Patent Number: 4,989,387

[45] Date of Patent: Feb. 5, 1991

[54] CEILING SYSTEM WITH STAKED ON CONNECTORS

[75] Inventors: Ronald W. Vukmanic, Naperville; John S. Borucki, Bloomingdale; Chester A. Stanley, Des Plaines; James J. Dunn, St. Charles, all of Ill.

[73] Assignee: Chicago Metallic Corporation, Chicago, Ill.

[21] Appl. No.: 397,909

[22] Filed: Aug. 24, 1989

[51] Int. Cl.[5] ..... E04B 9/10

[52] U.S. Cl. ..... 52/667

[58] Field of Search ..... 52/484, 666, 667, 665

[56] References Cited

U.S. PATENT DOCUMENTS

| | | | |
|---|---|---|---|
| Re. 31,201 | 4/1983 | Sauer | 52/667 |
| 2,711,138 | 6/1955 | Hart | 108/16 |
| 3,354,598 | 11/1967 | Nicholson | 52/732 |
| 3,385,020 | 5/1968 | Olson | 52/495 |
| 3,619,960 | 11/1971 | Thompson | 52/241 |
| 3,791,089 | 2/1974 | Alderman | 52/484 |
| 4,100,703 | 6/1978 | Sickler | 52/16 |
| 4,108,563 | 8/1978 | Brown et al. | 403/347 |
| 4,161,856 | 7/1979 | Brown et al. | 52/667 |
| 4,389,828 | 6/1983 | Cary | 52/665 |
| 4,462,198 | 7/1984 | Sharp | 52/667 |
| 4,494,350 | 1/1985 | Sharp | 52/665 |
| 4,601,153 | 7/1986 | Dunn et al. | 52/666 |
| 4,611,453 | 9/1986 | Worley | 52/667 |
| 4,779,394 | 10/1988 | Shirey et al. | 52/667 |
| 4,794,745 | 1/1989 | Platt et al. | 52/484 |

*Primary Examiner*—John E. Murtagh

*Attorney, Agent, or Firm*—Hill, Van Santen, Steadman & Simpson

[57] ABSTRACT

Main runner members and cross members having an inverted T-shaped configuration characterized by an outer edge of the flanges being bent upwardly at an angle to form a bevelled edge to give the flanges an appearance of being substantially thicker than the material used to form the flange. The cross members include a connecting element, preferably formed as a separate element, having spacer bumps, and a U-shaped tab extending from one surface, the U-shaped tab forming a first abutment and a portion of the element is cut and deformed out of the plane of the element on an opposite surface to form a second abutment surface to coact with the first abutment surface of an adjacent connecting element to hold the two aligned cross members in a slot of a main runner.

19 Claims, 2 Drawing Sheets

FIG. 5
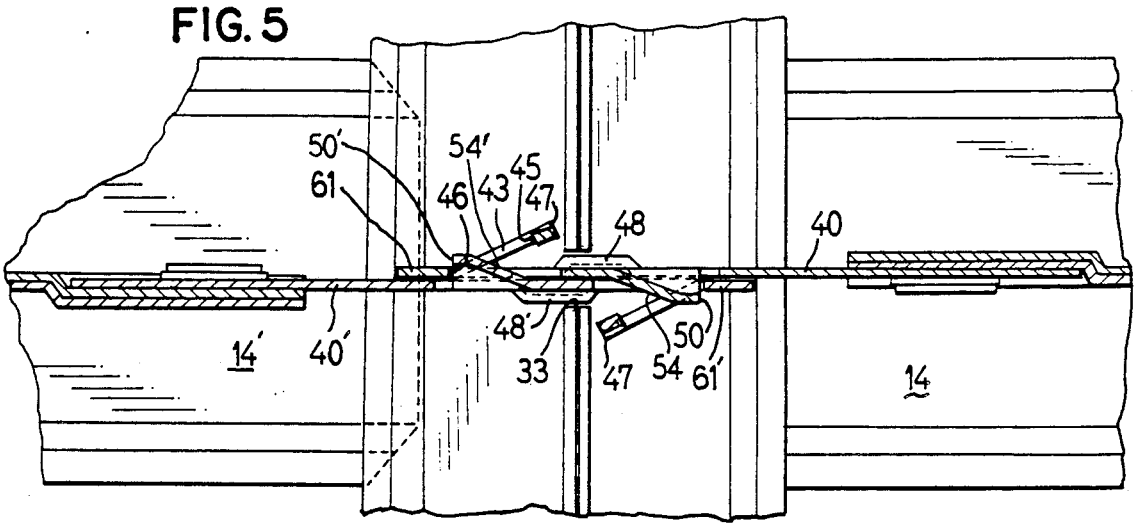
FIG. 6
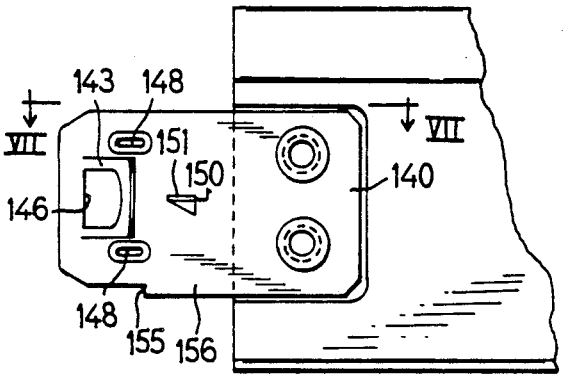
FIG. 7
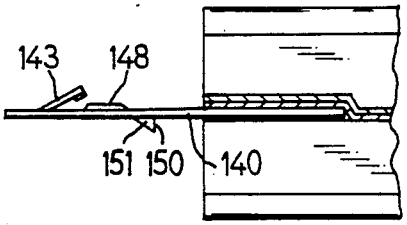
FIG. 8
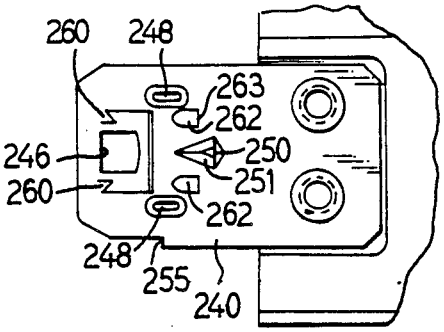
FIG. 10
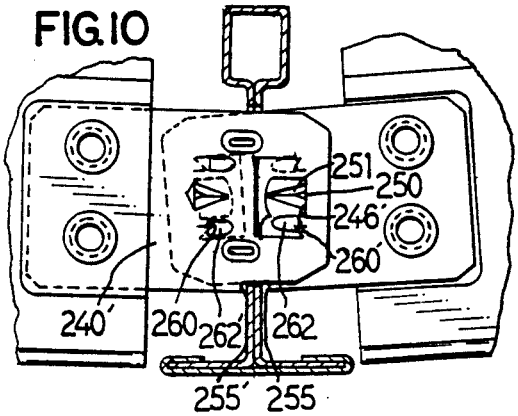
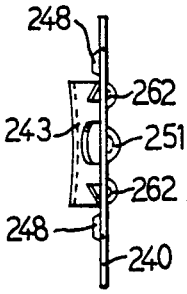
FIG. 9

CEILING SYSTEM WITH STAKED ON CONNECTORS

BACKGROUND OF THE INVENTION

In a suspended ceiling system having main runner members and cross members arranged in a grid pattern to support ceiling panels, the present invention is directed to the structure of the members and to the connection used between cross members and the main runner.

Suspended ceiling systems utilizing inverted T-shaped members for both the main runners and the cross members are known. An example is disclosed in U.S. Pat. No. 4,601,153, whose disclosure is incorporated by reference. The runners, as disclosed in this patent, have an inverted T configuration with a central web connecting a bead portion to two outwardly extending flanges, which flanges extend substantially in a single plane, which is substantially the plane of the panels being supported on these flanges.

To interconnect the cross members into the main members, the members may be provided with a tongue-like connecting element, which may be integral as disclosed in the above-mentioned patent or may be a separate element, which is secured on the cross member such as disclosed by U.S. Pat. No. 4,108,563.

In the U.S. Pat. No. 4,601,153, the connecting tongue has a portion cut out and bent out of the plane to form a first abutment surface, another portion pushed out of the plane of the tongue to form a second abutment surface, and is provided with a step to form a third abutment surface. When the tongue is inserted through a slot in the main runner from one direction and a second tongue of a second cross member is inserted in the opposite direction, the first abutment of the first tongue engages the second abutment of the second tongue on one side of the web of the main runner, while the second abutment of the first tongue is engaged by the first abutment of the second tongue, and the third abutments engage each side of the web to lock the cross members in the assembled position.

An advantage of having the connecting element as a separate element that is secured to the web of the flange is that the connecting elements can be made separately and used with different style cross members. This provides a greater flexibility in the manufacture of runners for a suspended ceiling grid to provide different shapes and structures. It is also desirable to construct the various flanges and abutment surfaces so that they may be passed through the slot in the web of the main runner without becoming hung-up or catching on portions of the runner.

SUMMARY OF THE INvENTION

The present invention is directed to providing main runner members and cross runner members for a suspended ceiling system, wherein the runners are provided with flanges having upturned edges to provide an offset between the base of the flange and the members supported on the flanges to obtain a different architectural and aesthetic results.

The invention is also directed to providing a connecting member, preferably a separate element, which is secured or staked on the cross member, which has an improved arrangement of the first and second abutment surfaces to overcome problems with the assembly of the cross member in the main runner and which provide a better and more secure joint.

To accomplish these goals, the present invention is directed to a suspended ceiling system comprising main runner members extending parallel to each other and cross members extending between the main members at spaced intervals, each of said members having an inverted T configuration with a pair of oppositely extending flanges connected by a web to a bead, each cross member having a tongue-like connector element extending past the end of the web and the end of the cross member for insertion through a slot in the main runner member to form a connection therewith and an interlocking arrangement with an element extending in the opposite direction from the cross member, each of the elements being provided with a stamped-out portion forming a first abutment edge, a second stamped-out portion in the opposite direction forming a second abutment edge, a step forming a third abutment edge, and spacer means being formed in the surface to extend out of the plane of the surface in the same direction as the first stamped-out portion to urge the two tongues of opposite extending cross members into contact with each other.

Preferably, the first stamped-out portion has a U shape to form a substantially straight-line abutment surface in the element. The U-shaped member has a slightly concavely curved configuration and is provided with a curved inner edge to prevent catching during the step of inserting the tongue through a slot in the main runner.

The second stamped-out portion can be formed as a triangular depression which is constructed to form a second abutting surface which extends at right angles to the surface of the tongue or forms a hook shape for engaging the first abutment surface. In one embodiment, the second abutment surface is a dimple arrangement, whereas in the other embodiment it is a cut-and-bent member. In a third embodiment, the first flap member, when stamped-out of the plane of the tongue, forms two points spaced from the abutment surface, which will be engaged in two pockets or sockets formed adjacent the second abutment surface to prevent inadvertent disconnection of the connection, even when the cross members are raised to form an angle other than substantially perpendicular to the plane of the web of the main member.

While the improved connecting tongue is preferably used as a separate member which is secured on the cross member, the cross member can have the convention T shape or can have the flanges bent upwardly adjacent the outer edges so as to raise the board carried on the flanges above the bottom surface of the flange and provide a bevelled edge surface to obtain a desired aesthetic look.

Other advantages and features of the invention will be readily apparent from the following description of the preferred embodiments, the drawings and claims.

BRIEF DESCRIPTION OF THE DRAWINGS

FIG. 5 is a cross sectional view taken approximately along the lines V—V of FIG. 4;

FIG. 6 is an enlarged side view of an end of another type of cross member having an embodiment of the connecting element in accordance with the present invention;

FIG. 7 is a cross sectional view taken approximately along the lines VII—VII of FIG. 6;

FIG. 8 is a partial side view of a second embodiment of the connecting element in accordance with the present invention;

FIG. 9 is a partial end view of the connecting element of FIG. 8; and

FIG. 10 is a cross sectional view similar to FIG. 4 illustrating a connection of two cross members in the main runner.

DESCRIPTION OF THE PREFERRED EMBODIMENTS

Figure 1:
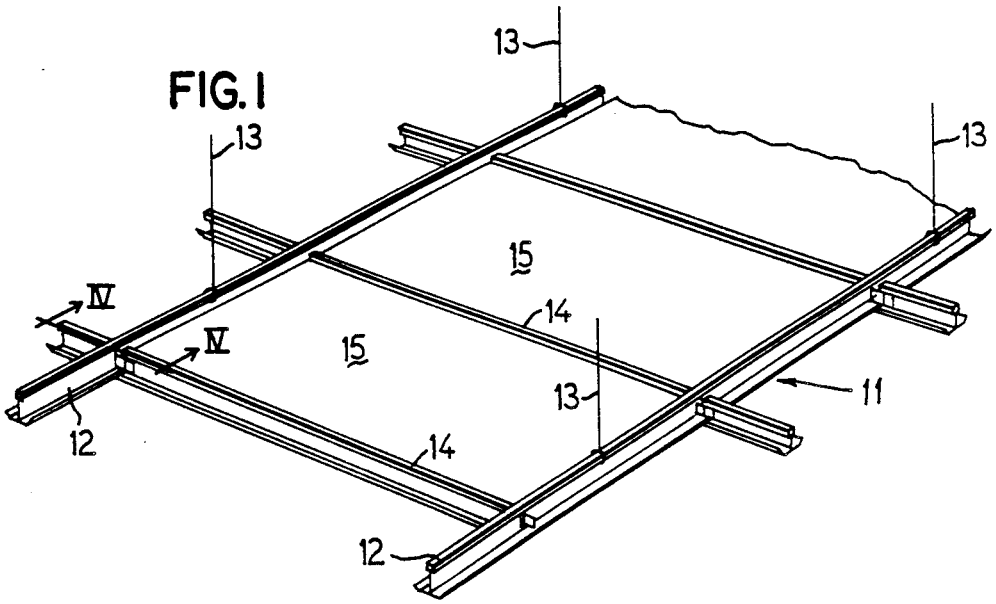
FIG. 1 is a perspective view with portions broken away for purposes of illustration of a suspended ceiling system illustrating the manner in which the various grid members are assembled to support ceiling panels in accordance with the present invention.

The principles of the present invention are particularly useful when incorporated in a suspended ceiling system, generally indicated at 11 in FIG. 1. The suspended ceiling system 11 includes main runner members 12, which extend parallel to each other and are supported by a suspension arrangement, such as wires 13. Extending between the parallel runners 12 are cross members or runners 14, which coact with the main runners or members 12 to form rectangular spaces for receiving rectangular panels, such as 15.

Figure 3:
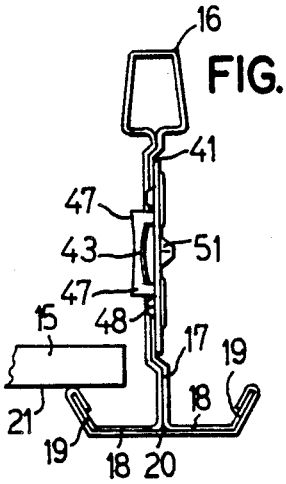
FIG. 3 is an end view of the cross runner illustrated in FIG. 2.
Figure 2:
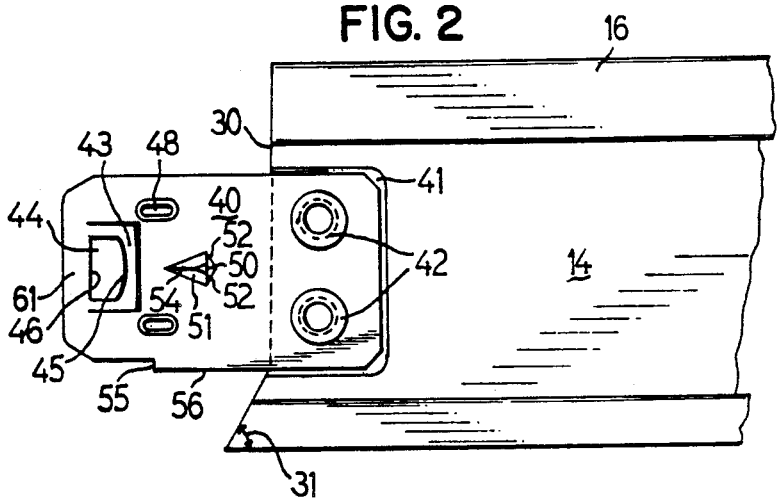
FIG. 2 is an enlarged side view of an end of a cross member illustrating the connecting tongue of the present invention.
Figure 4:
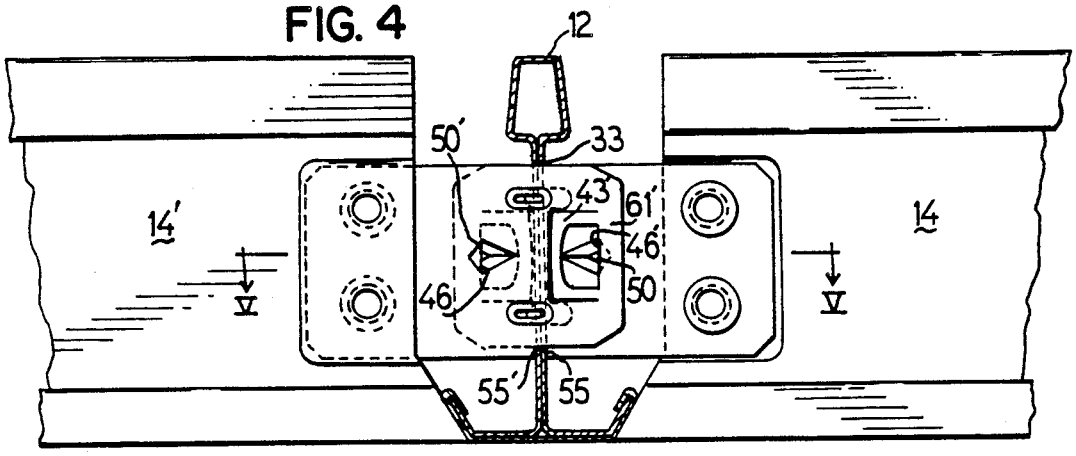
FIG. 4 is a cross sectional view taken along the lines IV—IV of FIG. 1.

As best illustrated in FIGS. 2, 3 and 4, each of the runners 12 and 14 is composed of two pieces of sheet metal, with the first piece being bent to form a hollow, trapezoidal bead 16 with a pair of webs 17 extending down to two outwardly extending flanges 18, 18. Each of the flanges 18 is bent at a lateral offset portion from the webs 17 at an angle of approximately 45°-60° to form an upward portion or edge 19. A cap strip 20 covers the bottom of the flange and is bent onto the two edge portions 19. The cap strip enables providing different colors or finishes to be viewed by the occupants of the room having the suspended ceiling 11.

As illustrated in FIG. 3, the upstanding edge portions 19 form beveled surfaces or sides, which give the appearance of a much thicker flange and also raise the plane surface 21 of the panels 15 above the plane of the cap 20 to provide a different aesthetic look for the system 11.

As best illustrated in FIGS. 2 and 4, each of the cross members 14 has an end surface or edge 30 which, adjacent the flanges, is cut at an angle 31 so as to form a bevelled or mitered edge which will meet with the upturned edges 19 of the main runner 12, as best illustrated in FIG. 4.

To form the connection of the cross member 14 with the main runner or member 12, each of the cross members 14, on the edges 30, is provided with a tongue-like connector element, which is illustrated as being a separate element 40, secured in a depression 41 of the cross member 14 by fastening means, such as integral rivets or fasteners 42. The depression 41 has a depth, which is approximately equal to twice the thickness of the member 40 so that when two of the cross members 14 are connected together through a single slot 32 in the main runner 12, the members 14, 14' are axially aligned. While the fasteners 42 are formed by deforming web material through the openings in the element 40 and then forcing the projection portion flat against the element, they could be separate rivets or fasteners.

Each of the connector elements 40 is provided with a shear tab or U-shaped flap 43 which is bent out of the plane of the element 40 and has a second cut portion 44 with a curved edge 45 and a straight edge 46, which edge 46 forms a first abutment surface. The tab 43, when bent from the plane, as illustrated in FIG. 3, preferably has a bight portion that is slightly concavely curved or arched so that the corners, such as 47, extend the furthest distance out from the plane of the connector element 40. This prevents the flap 43 from catching on items when the connector 40 is inserted into the slot 33 and the edges of the legs will contact the edges of the slot 33 during insertion.

The connector element also has spacing means which are formed by two oval-shaped dimples 48, 48, which are pressed out of the plane of the element 40 in the same direction as the tab 43. A second abutment surface 50 is formed by cutting and bending a portion of the element 40 in the opposite direction, as illustrated in FIGS. 3 and 5. To insure that the edge 50 extends perpendicular to the plane of the element 40, the portion 51 is cut along two rake angles 52 to provide sufficient material so that as the material is forced out of the plane, the edge forming the abutment 50 extends in a perpendicular plane. By increasing the angle of the edges 52, it is possible to form a hook-shaped abutment surface.

To complete the connector 40, a third abutment surface 55 is formed by a step along a bottom edge 56 of the element. This surface 55 is aligned with the spacer bumps 48 and, as illustrated, the spacer bumps 48 and the third abutment surface 55 are disposed between the first abutment surface 46 and the second abutment surface 50.

In forming a connection between two cross members 14 and 14' with the main runner 12, one of the cross members, such as 14, has its tongue-like connector element 40 inserted through the slot 33. As illustrated, when the connector element 40 of the member 14 is inserted through the slot 33, the third abutment 55 engages a surface of the web adjacent the slot 33 as the leading end containing the first abutment surface 46 and the bent-out flap 43 has passed through the slot. Due to the position of the spacer bumps 48, they will be engaged by an edge of the slot 33, as best illustrated in FIG. 5. When the second cross member 14' has its tongue-shaped connector element 40' inserted through the slot 33, the leading edge having the flap 43' and the first abutment surface 46' will pass through the slot 33 and the third abutment surface 55' engages the opposite side of the web 17. As the second connector 40' is moved through the slot, a band or strip 61' will slide up the tapered surface 54 until it moves thereby so that the first abutment surface 46' is engaged by the second abutment surface 50. In a similar manner, the tapered surface 54' of the connector 40' moves the band 61 laterally outward until the first abutment edge 46 snaps over the second abutment edge 50'. When both connectors are moved to the connecting position, their bumps 48 and 48' engage opposite edge portions to hold the connector members 40 and 40' tightly against one another and in the center of the slot 33.

As mentioned, the dimple 51 which forms a second abutment surface 50, is displaced out the of the sheet forming the element 40. FIGS. 6 and 7 show an embodiment of the connector element 140, which is substantially the same structure as the element 40, except that the second abutment surface 150 is formed by a triangular tab 151 which is cut and bent out of the plane of the sheet of material forming the element 140. As illustrated, the tab 151 is bent on a line which extends substantially parallel to a longitudinal axis of the element 140, which is also parallel to the edges, such as the top edge 152 and the bottom edge 156. The element 140 has a first abutment surface 146 which is formed by the bent-out tab 143 in the same manner as the first abutment 46 as formed by the tab 43 in the embodiment of FIGS. 2, 3 and 4. The element 140 is provided with spacer bumps, such as 148, that are the same as the bumps 48 and is provided with a step forming a third abutment surface 155 which is the same as the abutment surface 55.

It should be pointed out that the element 140 is shown as being connected to a standard-type runner which has flanges 118 that do not have the upturned edge portions, such as the portion 19 of FIGS. 3 and 4.

A third embodiment of the connector element, which is illustrated as being attachably secured to a standard inverted T member, as illustrated in FIGS. 8, 9 and 10. This third embodiment 240 is provided with spacing means, such as formed by the dimples 248, 248, which are the same as the dimples 48 of FIG. 2, is provided with a step to form a third abutment surface 255, which is the same as the third abutment surface 55 and 155 of the previous embodiments, and is provided with an outward depression 251 to provide the second abutment surface 250. However, the cut for forming a tab 243, in addition to forming the first abutment surface 246, provides two points or projections 260, 260. The points are formed because the shear cut for the tab 243 leaves points adjacent the first abutment surface 246. The device is also provided with a pair of sockets or pockets 262 that extend on the same side as the bump 251 forming the second abutment surface 250. Each of the sockets, as illustrated in FIG. 8, has a shear line 263 to form an opening for receiving a point 260 of an adjacent member, as illustrated in FIG. 10. As illustrated, the two sockets 262, 262 extend into the opening formed by the bent-out tab 243' of the second element 240'. When the cross member, such as 14*a*, is raised from the horizontal position, as illustrated in FIG. 10, one of the sockets 262 will receive one of the points 260' as one of the sockets 262' of the element 240' will receive a point 260 of the element 240. The coaction between the sockets and the points provides an interlock to prevent disengagement of the connection, even when subjected to vibrations or movement which might occur from seismic activity.

While the preferred embodiment of the coupling elements 40, 140 and 240 is a separate element which is secured to the web of the cross member, the design of the element, including the lateral spacing means, the first, second and third abutment surfaces could be formed on an integrally formed tongue-type connector.

Although various minor modifications may be suggested by those versed in the art, it should be understood that we wish to embody within the scope of the patent granted hereon all such modifications as reasonably and properly come within the scope of our contribution to the art.

We claim:

1. A suspended ceiling system comprising main members extending parallel to each other and cross members extending between the main members at spaced intervals, each of said members having an inverted T configuration with a pair of oppositely extending flanges connected by a web to a bead, each cross member having an end with the flanges terminating in end edges and the web having a tongue-like connector element extending beyond the end edges of the flanges and an end of the bead, each of the webs of the main members having elongated slots for receiving the connector element of the cross member with the end edge of the flange being received against an outer lateral surface of the flange of the main member and the end of the bead spaced from the bead of the main member, each of the connector elements having a cut-out portion forming a first abutment surface adjacent a leading end of the connector element, a portion of the connector element spaced inward from the first abutment surface being bent out of the plane of the connector element to form a second abutment surface disposed on a first surface of the element, spacer means including a pair of detents formed in the element between the first and second abutment surfaces to extend from a second surface opposite the first surface of the element to space the element from an edge of the slot in the main member, a U-shaped flap having a bight portion connecting two legs with the bight portion being bent into a concave shape, said U-shaped flap being deformed out of said element on said second surface, said U-shaped flap being formed by the cut-out portion forming the first abutment and by an outer U-shaped cut, said cut-out portion having a curved edge portion opposite said first abutment surface to prevent catching of the U-shaped flap during insertion of the connector element through the slot of the main member, and a third abutment formed in an edge of the element for engaging the web of the main member as the connector element is inserted therethrough as the end edges of the flanges engage the lateral surface of the flange of the main runner.

2. A suspended ceiling system according to claim 1, wherein the portion of the connector element being bent in the first direction to extend above the first surface comprises a wedge-shaped bump having an edge extending substantially perpendicular to the plane of the first surface to form said second abutment surface.

3. A suspended ceiling system according to claim 2, wherein said wedge-shaped bump is formed by two triangular-shaped sub-portions forming a camming surface for moving a portion of the leading edge of adjacent connector element to cam over said bump for engagement of the first abutment surface on the second abutment surface during forming of a connection.

4. A suspended ceiling system according to claim 2, wherein the element is a separate element secured to the web of the cross member by fasteners.

5. A suspended ceiling system according to claim 4, wherein said web is provided with a depression for receiving a proximal end of said separate element, said depression having a depth of approximately twice the thickness of said separate element so that when the connector element of two cross members are inserted through the same slot from opposite sides, the members are aligned.

6. A suspended ceiling system according to claim 2, which includes a pair of sockets deformed out of the plane of the connector element to extend along the bump, said sockets being spaced to be received in an aperture formed by the flap deformed out of the connector element of the opposite cross member, each of said connector elements, at the base of the flap, having cuts in the flap to form points projecting in the plane of the element, one of said points being received in one of the sockets when the cross member is moved from a horizontal position relative to the main member to prevent disengagement of the abutment surfaces forming the connection.

7. A suspended ceiling system according to claim 6, wherein each of said connector elements is a separate element, each of the cross members adjacent the end having a depression with a depth twice the thickness of said element, and fastening means for securing said connector element in the depression.

8. A suspended ceiling system according to claim 1, wherein the portion of the connector element forming the second abutment surface is a triangular tab bent out of the plane of the element along a bend line extending parallel to an upper edge of said element.

9. A suspended ceiling system according to claim 8, wherein the connector element is a separate element, said cross member adjacent the end having a depression of a depth approximately twice the thickness of said separate element and means for securing a proximal end of the separate element in the depression.

10. A suspended ceiling system according to claim 5, wherein each of the flanges of the members has an upturned edge portion extending at an angle of less than 90° to the rest of the flange to form a bevelled lateral surface, and each of the cross members has the ends of the flanges cut at an angle corresponding to the angle of said upturned edge portions to form a bevelled end surface corresponding to the bevelled surface of the flanges.

11. A cross member for a suspended ceiling system, said cross member extending between main members, said cross member having an inverted T configuration with flanges extending on opposite sides of a web portion, said cross member having a connecting element secured to an end of the cross member, said connecting element having a U-shaped tab being bent out of a first surface of the element with an edge of an inner aperture forming a portion of the U-shaped tab forming a first abutment surface adjacent a distal end of said element, the inner aperture forming the U-shaped flap having a curved edge opposite the edge forming the first abutment surface and a bight portion of the tab being bent into a concave shape, a portion of the element being cut and depressed out of the plane of the element on a second surface to form a second abutment surface spaced from the first abutment surface toward the proximal end of the connecting element, at least one spacing bump being deformed out of the connector element on the first surface and being disposed on a line extending between the first and second abutment surfaces and a third abutment being disposed on an edge of the element approximately on said line for engaging a side of a web of a main member as the connecting element extends through a slot therein with the spacing bump engaging a lateral edge of the slot, and the first and second abutment surfaces being spaced approximately an equal distance on both sides of the web to coact with the first and second abutment surfaces of the connecting element extending in the opposite direction through said slot.

12. A cross member according to claim 11, wherein the depression forming the second abutment surface is a triangular-shaped flap bent out of the plane of the element along a bend line extending substantially parallel to an upper edge of the element.

13. A cross member according to claim 11, wherein the outer U-shaped cut forming the tab forms two projections adjacent the first abutment surface and said element includes two sockets being depressed in the direction of the portion forming the second abutment surface, said sockets opening to receive said projections when the cross member is moved out of the horizontal plane after assembly with a second cross member in the slot of the main member.

14. A cross member according to claim 11, wherein said portion forming the second abutment surfaces is a wedge-shaped portion having an edge extending substantially perpendicular to the plane of the second surface to form said second abutment surface, said wedge-shaped portion is formed by two triangular-shaped subportions forming a camming surface for moving a portion of the leading edge of adjacent connector element to cam over said wedge-shaped portion for engagement of the first abutment surface on the second abutment surface during forming of a connection.

15. A suspended ceiling system comprising main members extending parallel to each other and cross members extending between the main members at spaced intervals, each of said members having an inverted T configuration with a pair of oppositely extending flanges connected by a web to a bead, each of the flanges of the members having an upturned edge portion extending at an angle of less than 90° to the rest of the flange to form a bevelled lateral surface, each of the cross members having the ends of the flanges cut at an angle corresponding to the angle of said upturned edge portions to form a bevelled end surface corresponding to the bevelled surface of the flanges, each cross member having an end with the web having a tongue-like connector element extending beyond the bevelled end surface of the flanges and an end of the bead, each of the webs of the main members having elongated slots for receiving the connector element of the cross member with the bevelled end surfaces of the flanges being received against the bevelled lateral surface of the flange of the main member and the end of the bead spaced from the bead of the main member, each of the connector elements having a cut-out portion forming a first abutment surface adjacent a leading end of the connector element, a portion of the connector element spaced inward from the first abutment surface being bent out of the plane of the connector element to form a second abutment surface disposed on a first surface of the element, spacer means including a pair of detents formed in the element between the first and second abutment surfaces to extend from a second surface opposite the first surface of the element to space the element from an edge of the slot in the main member, and a third abutment formed in an edge of the element for engaging the web of the main member as the connector element is inserted therethrough as the end edges of the flanges engage the lateral surface of the flange of the main runner.

16. A suspended ceiling system according to claim 15, wherein the connector element is a separate element secured on the end of the cross member.

17. A suspended ceiling system according to claim 16, wherein the end of the cross member has a depression for receiving a proximal end of the connector element, said depression having a depth approximately twice the thickness of said connector element so that cross members on opposite sides of the main member will be in alignment as the connector elements engage one another in a slot in the main member.

18. A suspended ceiling system according to claim 15, wherein each of the connector elements includes a U-shaped flap being deformed out of said element on said second surface, said U-shaped flap being formed by the cut-out portion forming the first abutment surface, said cut-out portion having a curved edge portion to prevent catching of the U-shaped flap during insertion of the connector element through the slot of the main member.

19. A suspended ceiling system according to claim 15, wherein the U-shaped flap has a bight portion connecting two legs, said bight portion having a concave shape so that the legs contact an edge of the slot during insertion therein.

* * * * *